343/700 MS

United States Patent [19]

Schaubert et al.

[11] 4,367,474

[45] Jan. 4, 1983

[54] FREQUENCY-AGILE, POLARIZATION DIVERSE MICROSTRIP ANTENNAS AND FREQUENCY SCANNED ARRAYS

[75] Inventors: Daniel H. Schaubert; Frederick G. Farrar, both of Silver Spring, Md.; Scott T. Hayes, Raleigh, N.C.; Arthur R. Sindoris, Silver Spring, Md.

[73] Assignee: The United States of America as represented by the Secretary of the Army, Washington, D.C.

[21] Appl. No.: 175,543

[22] Filed: Aug. 5, 1980

[51] Int. Cl.[3] ..... H01Q 1/38

[52] U.S. Cl. ..... 343/700 MS

[58] Field of Search ..... 343/700 MS, 829, 854

[56] References Cited

U.S. PATENT DOCUMENTS 3,680,136 7/1972 Collings ..... 343/700 MS 4,053,895 10/1977 Malagisi ..... 343/700 MS 4,160,976 7/1979 Conroy ..... 343/700 MS 4,170,012 10/1979 Kaloi ..... 343/700 MS 4,259,670 3/1981 Schiavone ..... 343/700 MS

*Primary Examiner*—Eli Lieberman

*Attorney, Agent, or Firm*—Nathan Edelberg; Robert P. Gibson; Saul Elbaum

[57] ABSTRACT

An inexpensive, flush mounted microstrip antenna which is frequency agile and has polarization diversity. The frequency and polarization of the antenna can be selected by selecting the location of shorting posts in the antenna. The use of switching diodes in place of shorting posts provides the means of electronically switching the frequency and polarization characteristics of the antenna. Frequency-agility provides frequency scannable microstrip antenna arrays which also have polarization diversity. Frequency-agility, polarization diversity and frequency scannable arrays are controllable by digital means such as a computer.

10 Claims, 21 Drawing Figures

FREQUENCY-AGILE, POLARIZATION DIVERSE MICROSTRIP ANTENNAS AND FREQUENCY SCANNED ARRAYS

RIGHTS OF THE GOVERNMENT

The invention described herein may be manufactured, used or licensed by or for the Government of the United States of America for governmental purposes without payment to us of any royalties therefor.

CROSS REFERENCES TO RELATED APPLICATIONS

This invention is related to the U.S. Patent application, *ANTENNA WITH POLARIZATION DIVERSITY*, Ser. No. 103,798, filed Dec. 14, 1979 by Daniel H. Schaubert et al, now abandoned.

BACKGROUND OF THE INVENTION

This invention relates generally to microstrip antennas and microstrip antenna arrays and is particularly directed to microstrip antennas and arrays which are frequency-agile over a relatively large spectrum of frequencies. The invention also provides polarization diversity in frequency-agile microstrip antennas and arrays. This invention is also particularly directed to microstrip antenna arrays that are frequency-agile, have polarization diversity and can be electronically scanned. The frequency-agility is achieved without changing the physical dimensions of the antenna elements.

The microstrip antenna has been shown to be an excellent radiator for many applications requiring thin, inexpensive, conformal antennas which are rugged and have a low aerodynamic profile. However, their use has been limited by their inherent narrow operating bandwidth. A typical thin microstrip antenna will only operate over a frequency range of two or three percent. If it was desired to operate at some other frequency it was necessary to physically alter the dimensions of the radiating patch or to provide alternative radiating patches of different dimensions. Altering the dimensions was done by altering the length of the patch, by removing some of the conductor from the center of the patch or by placing small tabs of conductor along the edges of the patch. However, these alterations are permanent and do not allow for very rapid frequency changes. Another method of changing the operating frequency, which is not permanent, is to place electronically variable reactances along the edge of the conducting patch and connect them to the ground plane. These reactances, such as varactor diodes, require expensive, bulky, difficult to control equipment to provide precise analog bias voltages. If serveral antennas were required to track together in frequency, it was necessary to select matched varactors for each antenna or design custom bias networks for each antenna.

For many applications it is often highly desirable, especially when dealing with projectiles, missiles, aircraft and radar, to have antennas that have the capability of radiating energy over a wide range of frequencies with the frequency changes being made very rapidly. Since the instantaneous bandwidth of the microstrip antenna is small, i.e., approximately 2–3 percent, the capability of switching frequencies over a wide range would provide a considerable immunity to interfering signals. The prior art microstrip antennas do not have the capability of being switched rapidly and simply over a broad range of frequencies.

It is also highly desirable to hwave an antenna that has selectable polarization. To obtain polarization diversity in most prior art antenna it is necessary to have at least two antennas and associated power dividers, phase shifters and rf switches to provide complete polarization coverage. For mwany applications it would be beneficial to obtain polarization diversity with simple inexpensive equipment that is easily controlled or that can be controlled by a digital computer.

Another highly desirable feature for many applications is the ability to electronically scan the output beam of an antenna in conventional microstrip arrays. Because of the narrow range of the frequency response in prior art antenna arrays, it is necessary to either physically steer the array itself or to incorporate variable phase shifters into the feed lines of the individual antenna elements. These variable phase shifters are generally bulky, expensive and difficult to control.

This invention provides a method to achieve frequency-agility and polarization diversity in both individual antenna elements and arrays and a method to achieve electronic scanning in an antenna array. The described method is inexpensive, easily constructed and easily controllable.

It is therefore one object of this invention to provide a microstrip antenna which is capable of selectably radiating a wide spectrum of frequencies.

It is another object of this invention to provide a microstrip antenna that is capable of providing selectable polarization.

It is a further object of this invention to provide a microstrip antenna that is capable of being electronically scanned simply and easily by digital controls.

It is still another object of this invention to provide a microstrip antenna that provides selectable frequencies, selectable polarization and electronic scanning by means of simple electronic switching capable of being computer controlled, and thus instantaneously changable.

It is still a further object of this invention to provide a microstrip antenna constructed by standard printed circuit techniques that is conformal, has low profile and desirable aerodynamic qualities.

SUMMARY OF THE INVENTION

These and other objects, features and advantages of the invention are accomplished by a microstrip antenna which essentially comprises a dielectric substrate, a conductive layer forming a ground plane on one surface of the substrate, one or more conductive patches on an opposed surface, an rf input to each of the conductive patches and means to select the frequency of the antenna. Means can also be provided to select the polarization of the antenna. The means proposed to select the frequency and polarization of the antenna are shorting means to provide an electrical short circuit between selected locations on the one or more conductive patches to the ground plane. These shorting means may be shorting posts, switching diodes or other means to provide an electrical short circuit between the one or more conductive patches and the ground plane. The shorting posts may be permanently or removably installed. The switching diodes may be externally controlled by means such as computer controlled bias circuits. A microstrip antenna array, comprising more than one conductive patch, with sequentially increasing feed line lengths to each patch, which introduces a progressive phase delay, can be frequency scanned by simply switching the frequency characteristics of the conductive patches at the same time as the input frequency is changed.

BRIEF DESCRIPTION OF THE DRAWINGS

The above and further objects and novel features of the invention will more fully appear from the following description when the same is read in connection with the accompanying drawings. It is to be understood, however, that the drawings are for the purpose of illustration only, and are not intended as a definition of the limits of the invention.

DESCRIPTION OF THE PREFERRED EMBODIMENT

Figure 1A:
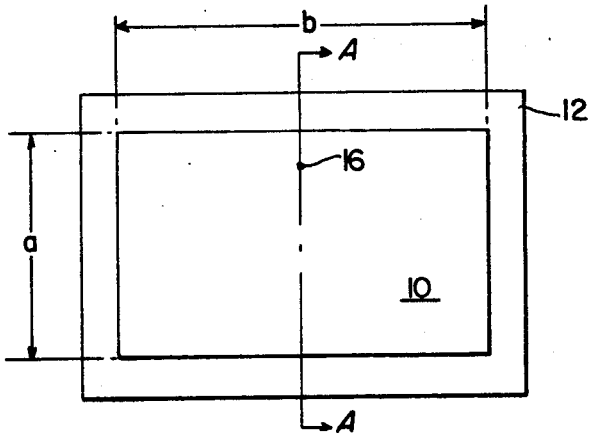
FIG. 1A PRIOR ART
FIGS. 1A and 1B illustrate a microstrip antenna as known in the prior art.
Figure 1B:
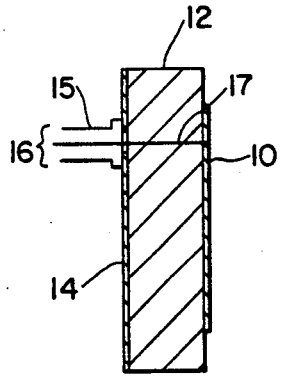
FIG. 1B PRIOR ART

Referring now to the drawings, wherein like reference characters designate like or corresponding parts throughout the several views, FIGS. 1A and 1B illustrate a microstrip antenna as known in the prior art. Basically the microstrip antenna consists of a dielectric substrate 12, with substantially parallel surfaces, a conductive patch 10 formed on one surface of the substrate and a ground plane 14 formed on the opposed surface of the substrate. An rf input is provided and may be one of several types such as a coaxial conductor, microstrip stripline, wave guide, etc. FIG. 1B illustrates the method of connecting a coaxial conductor 16, with the outer lead 15 connected to the ground plane 14 and the inner lead 17 connected to the conductive patch 10. The dielectric substrate 12 is made of a low loss dielectric substrate such as Teflon-fiberglass. The conductive patch 10 and the groud plane 14 is formed on the dielectric substrate by means known in the art, such as being etched on the substrate by standard printed circuit techniques. The frequency and impedance characteristics of the microstrip antenna as shown in FIGS. 1A and 1B are a function of the antenna size, the input feed location and the permittivity of the substrate. For example, to obtain a resonant frequency of a given wavelength a was made approximately equal to one-half the wavelength in the dielectric. The dimension b is chosen to provide the desired input impedance and radiation pattern.

Figure 2A:
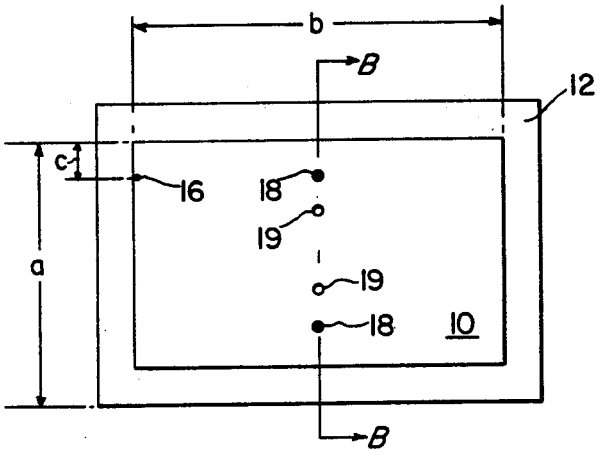
FIGS. 2A and 2B illustrate a microstrip antenna of the present invention showing shorting posts.
Figure 2B:
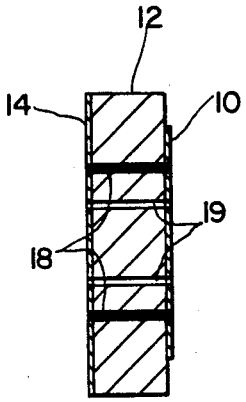

FIGS. 2A and 2B illustrate an embodiment of the present invention wherein the same basic microstrip antenna as shown in FIGS. 1A and 1B is modified to enable the operating frequency to be raised above that frequency corresponding to a resonant length equal to one-half wavelength in the dielectric. The microstrip antenna is provided with shorting means to provide a conductive path between ground plane 14 and conductive path 10. The shorting means shown in FIGS. 2A and 2B are shorting posts 18 which are placed in preselected prepositioned holes 19 to provide the desired frequency characteristics. The input feed means 16 is shown placed at a distance c from one edge of the conductive patch 10. The distance c is chosen to provide the desired input impedance. The shorting posts 18 may be of any conductive material such as a metallic bolt or rivet.

Figure 3A:
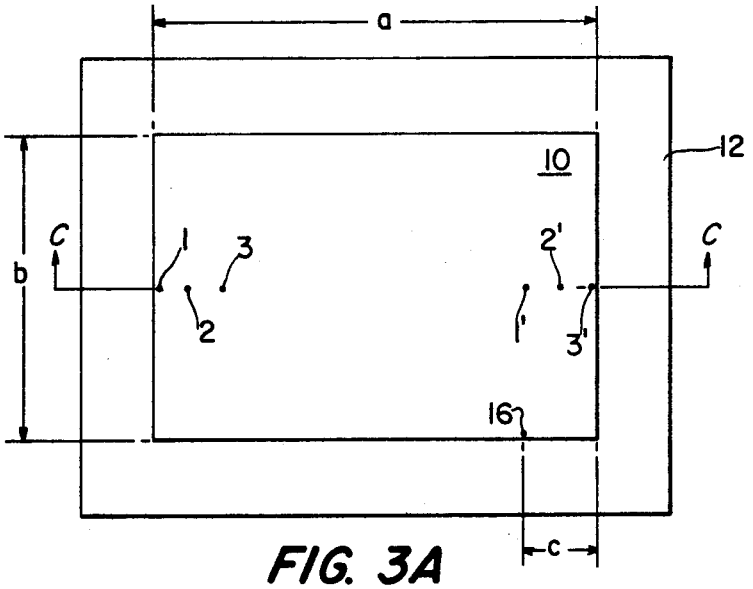
FIGS. 3A and 3B illustrate a microstrip antenna of the present invention with switching diodes and an external bias circuit.
Figure 3B:
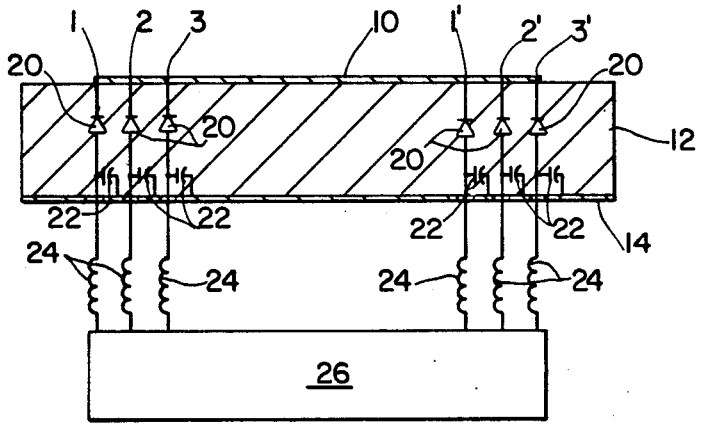
Figure 4D:
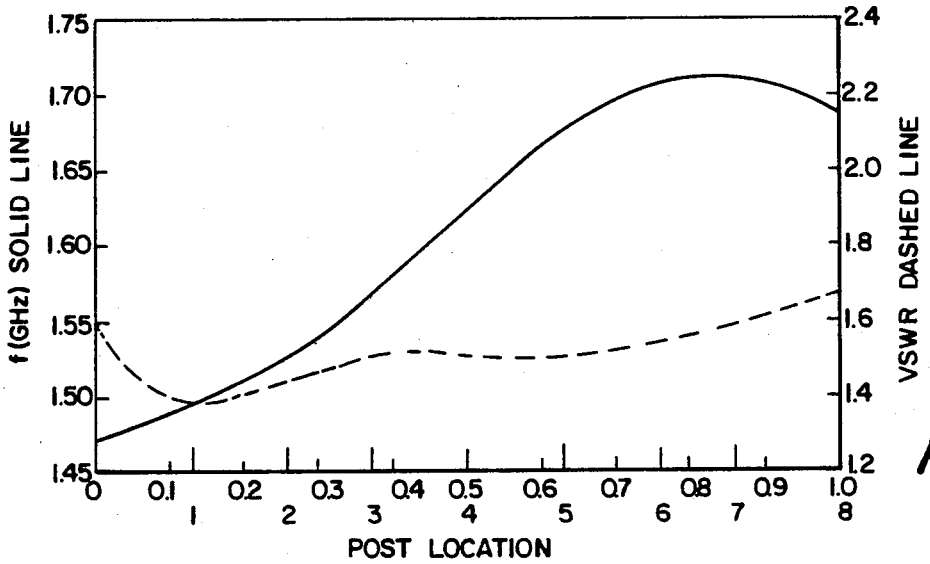
FIGS. 4A–4D illustrate a microstrip antenna of the present invention showing actual post or switching diode locations and the radiation patterns and operating characteristics resulting therefrom.
Figure 4A:
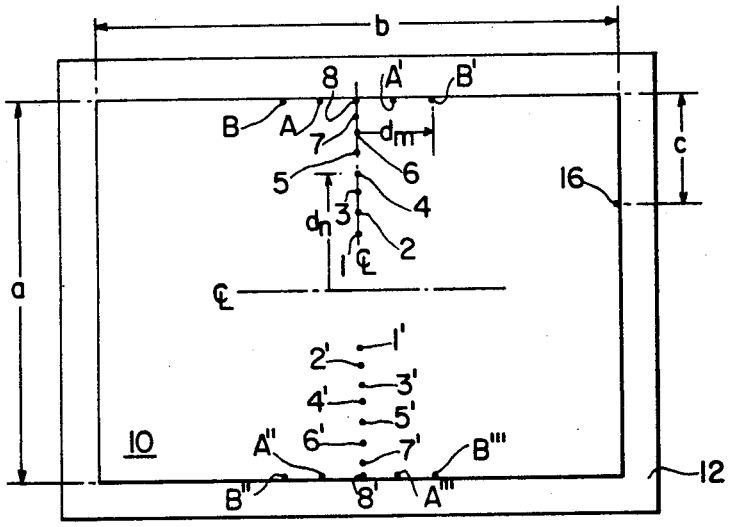

FIGS. 3A and 3B show a further embodiment of the present invention wherein the shorting means are switching diodes 20 placed at preselected positions as shown at 1, 2, 3 and at symmetrical locations 1', 2', and 3'. FIG. 3B is a sectional view taken at CC of FIG. 3A and shows a method of connection of the switching diodes 20. The switching diodes 20 are coupled to the ground plane 14 by rf bypass capacitors 22 and coupled to an external bias circuit 26 by rf chokes 24 which preclude rf going to the external bias circuit 26. The external bias circuit 26 is controllable by a simple means such as a digital computer. FIG. 4A illustrates a specific example of the present invention. This specific example is given as an illustration only and is not to limit the scope of the results obtainable. The dimensions of the microstrip antenna are as follows: a=6.2 cm, b=9.0 cm, c=1.5 cm, the substrate thickness equals 0.16 cm, the dielectric constant equals 2.55 and the shorting means positions are located as shown in Table 1. The values shown in Table 1 are normalized to the linear dimensions of the radiating patch.

TABLE 1

| Post Location (n) | $d_n/(a/2)$ | Post Location (m) | $d_m/(b/2)$ |
|---|---|---|---|
| 1 | 0.13 | A | .22 |
| 2 | 0.26 | B | .44 |
| 3 | 0.37 | | |
| 4 | 0.50 | | |
| 5 | 0.63 | | |
| 6 | 0.76 | | |
| 7 | 0.86 | | |
| 8 | 1.00 | | |

Figure 4B:
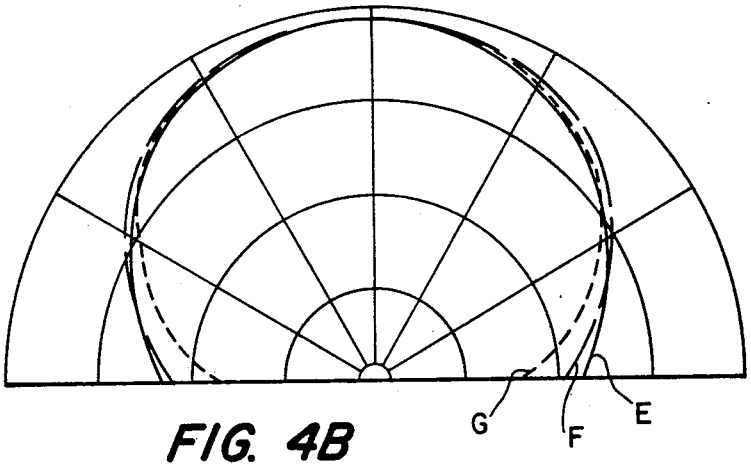
Figure 4C:
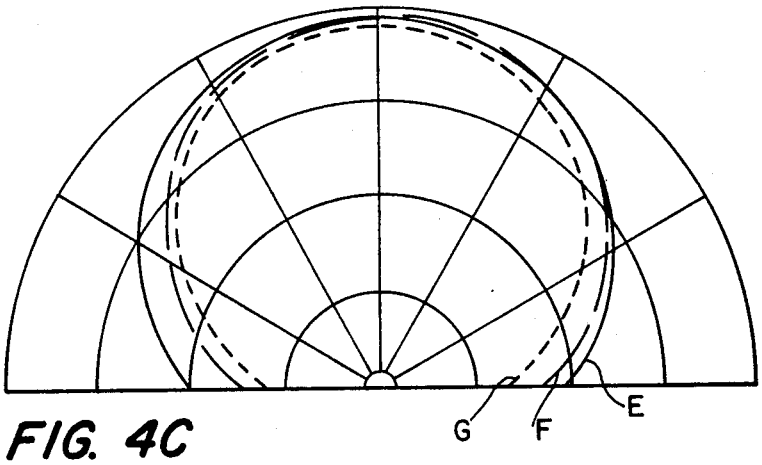

FIG. 4B shows the radiation patterns obtained in the E-plane; solid curve E is at a frequency of 1.47 GHz, with nothing shorted, long dashed curve F is at frequency of 1.97 GHz with diodes located at B, B', B'' and B''' shorted, short dashed curve G is a frequency of 1.70 GHz with locations 7 and 7' shorted. FIG. 4C shows the radiation patterns of the same frequencies in the H-plane. FIG. 4D illustrates graphically the frequency obtainable by moving or switching selected shorting means. The curves indicate actual measurements taken on the antenna shown in FIG. 4A. The shorting locations as shown in FIG. 4A are indicated by integers on the abscissa, fractional numbers on the abscissa indicate normalized values which are shown in Table 1. The dashed curve indicates the voltage standing wave ratios.

Figure 5:
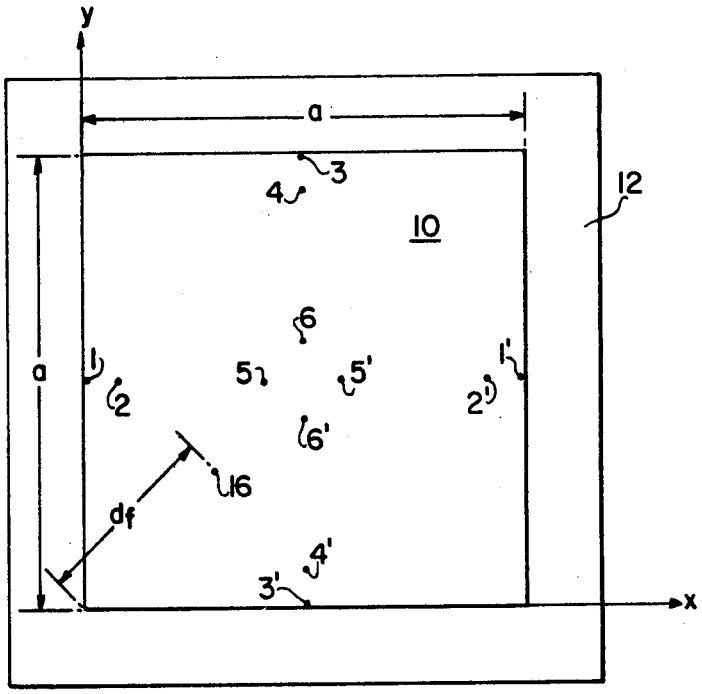
FIG. 5 illustrates a microstrip antenna of the present invention showing locations of shorting means to obtain both frequency agility and polarization diversity.

FIG. 5 illustrates an embodiment of the present invention with the addition of polarization diversity. For illustrative purposes an xy coordinate system is provided. As is known in the antenna art to obtain circular polarization the conductive patch 10 is made square and the rf input 16 is placed on the diagonal so that the input impedance is equal in both the x and y directions. The distance $d_f$ is chosen to select the desired input impedance. Shorting locations are provided along the line $x=a/2$ and $y=a/2$. The capability of providing both frequency-agility and polarization diversity can be seen by referring to FIG. 5 and Table 2 wherein vertical polarization is defined to be in the y direction and horizontal polarization is defined to be in the x direction.

TABLE 2

| Shorting Means Locations | Frequency | Polarization |
|---|---|---|
| 1 & 1' | $f_1$ | Vertical |
| | $f_2$ | Horizontal |
| 2 & 2' | $f_1$ | Vertical |
| | $f_3$ | Horizontal |
| 3 & 3' | $f_1$ | Horizontal |
| | $f_2$ | Vertical |
| 4 & 4' | $f_1$ | Horizontal |
| | $f_3$ | Vertical |
| 5 & 5' | $f_1$ | Right Circular |
| 6 & 6' | $f_1$ | Left Circular |
| 1,1', 3,3', 5,5' | $f_2$ | Right Circular |
| 1,1', 3,3', 6,6' | $f_2$ | Left Circular |

Also, $f_1$ is defined as the frequency of the conductive patch with no shorting means shorted, $f_2$ and $f_3$ being defined as frequencies with selected shorting means shorted. To obtain a desired polarization and a desired frequency, selected shorting means are shorted, for example, referring to Table 2, by selecting shorting locations 1 and 1' and inputting a frequency of $f_1$ vertical polarization can be obtained, however, the shorting of locations 1 and 1' and an input frequency of $f_2$ will provide horizontal polarization. It can be seen from this explanation and Table 2 that further shorting locations could be provided to provide additional frequencies and polarizations.

Figure 6:
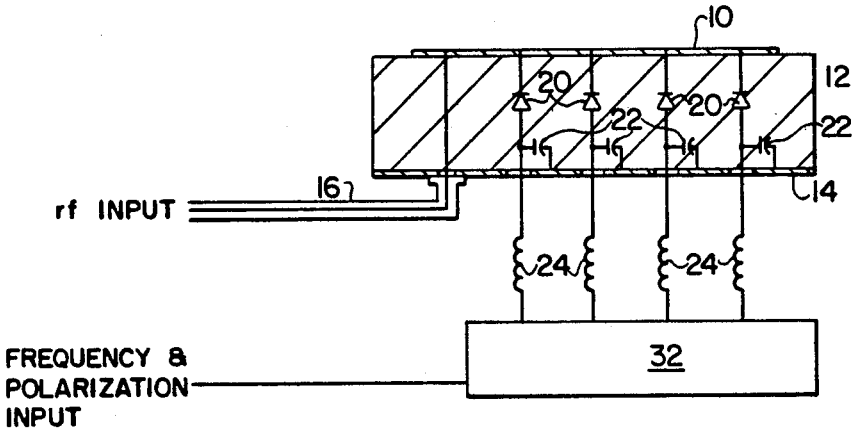
FIG. 6 is a cross sectional view of a microstrip antenna of the present invention illustrating the switching diodes and control means to provide frequency-agility and polarization diversity.

FIG. 6 is a partial schematic view of the antenna shown in FIG. 5. In this figure, the shorting means are shown as switching diodes 20 coupled to the ground plane 14 by bypass capacitors 22 and coupled to control means 32 by rf chokes 24. Control means 32 provides a bias input to switch selected switching means 20 to provide the desired frequency characteristics and plarization in response to a frequency and polarization input. Control means 32 is controllable easily and simply by digital computer means.

Figure 7:
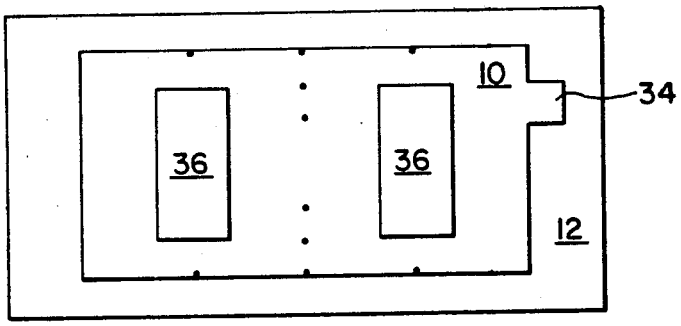
FIGS. 7 and 8 illustrate microstrip antennas of the present invention with sections removed to further change the frequency characteristics.
Figure 8:
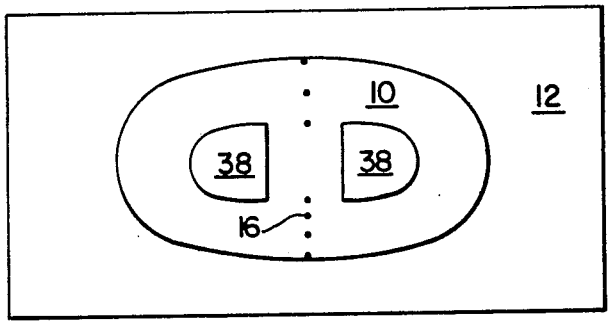
Figure 9:
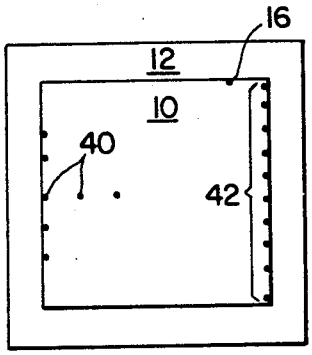
FIG. 9 illustrates the concepts of the present invention to obtain a quarter-wave microstrip antenna.

FIGS. 7 and 8 illustrate another embodiment of the present invention wherein shorting locations are provided in microstrip antenna conductive patches which have sections 36 and 38 of the conductive material removed. These sections further change the frequency characteristics of the microstrip antenna conductive patch as is known is the prior art. FIG. 9 illustrates another embodiment of the present invention, wherein shorting locations, generally at 40, are provided to change the frequency characteristics of a quarter-wave microstrip antenna. The quarter-wave microstrip antenna is formed by providing a shorting wall, generally at 42. The shorting wall 42 can be of shorting means such as shorting posts or switching diodes as discussed above.

Figure 10:
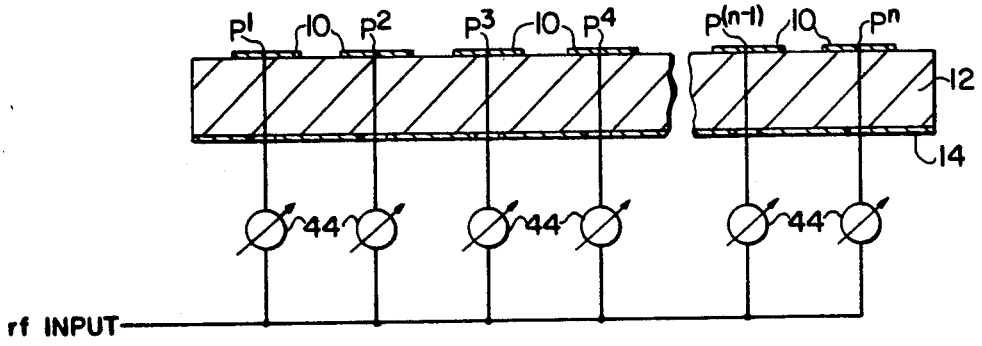
FIG. 10 PRIOR ART
FIG. 10 illustrates a microstrip antenna array as known in the prior art.
Figure 11:
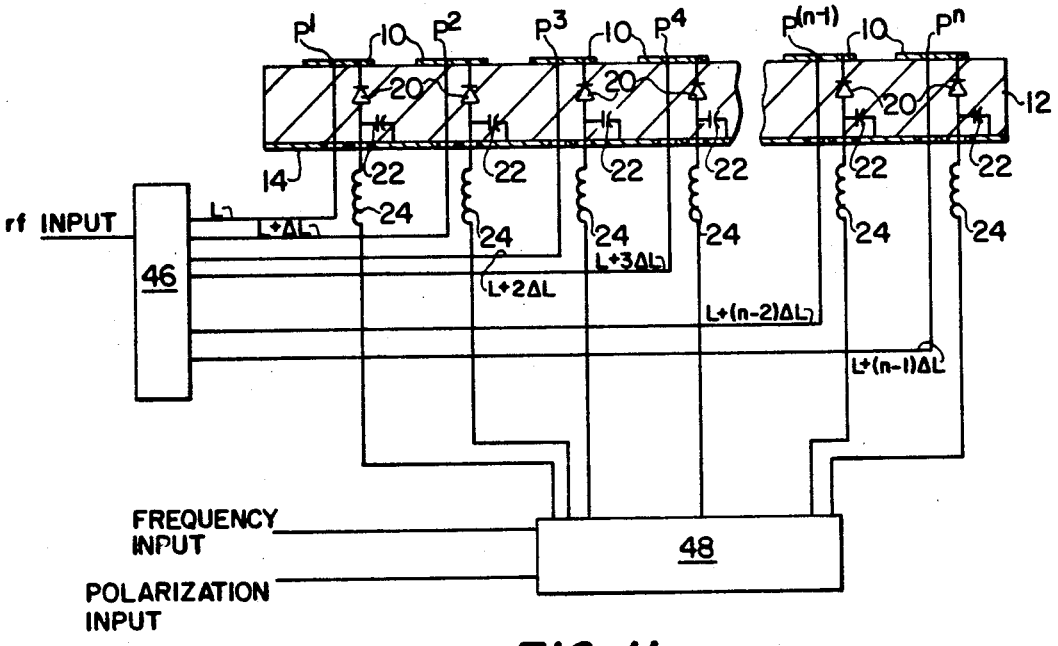
FIG. 11 illustrates a microstrip antenna array of the present invention showing the method of obtaining frequency scanning.
Figure 12A:
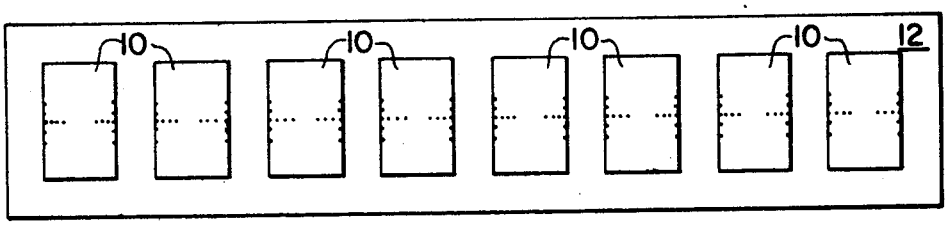
FIG. 12A illustrates a microstrip antenna array of the present invention with eight microstrip antenna elements.
Figure 12B:
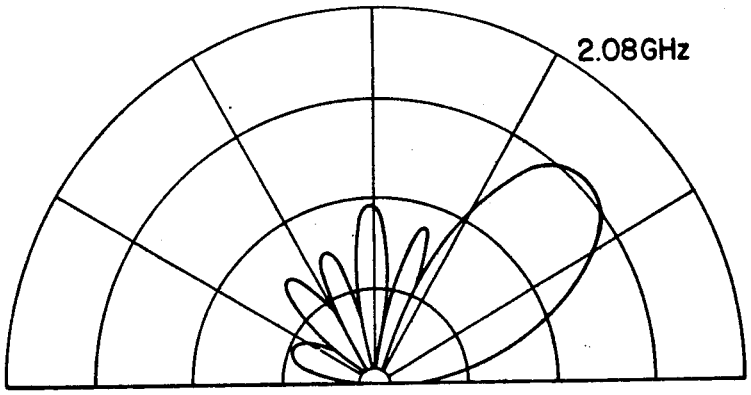
FIGS. 12B–12D show typical radiation patterns of the antenna array shown in FIG. 12A.
Figure 12C:
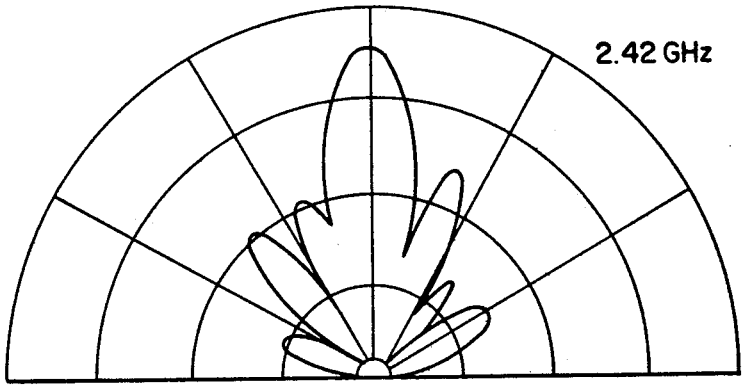
Figure 12D:
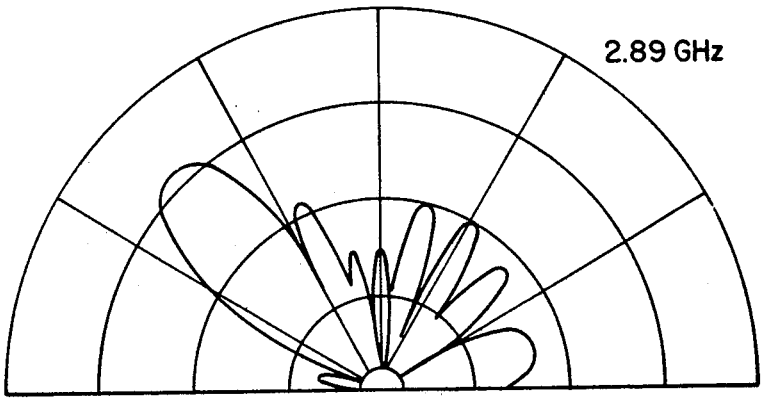

FIG. 10 is a schematic of a scannable microstrip antenna array as is known in the prior art. The array consists of multiple conductive patches 10, delineated as p1, p2, p3, etc., formed on one surface of a dielectric substrate 12, with a ground plane 14 formed on the opposing surface of the substrate. The scanning means in the prior art comprise phase shifters 44 placed in the feed lines between the rf input and each conductive patch. FIG. 11 illustrates an embodiment of the present invention wherein a frequency scannable microstrip antenna array comprises multiple conductive patches 10 formed on a dielectric substrate 12, with a conductive plane 14 formed on the opposite surface of the substrate 12. Switchable diodes 20 are coupled to each conductive patch 10 and coupled to ground plane 14 by bypass capacitors 22 and further coupled to control means 48 by rf chokes 24. An rf input is provided to each of the conductive patches 10 by a feed network comprising, for example, a power divider 46 or directional couplers and delay lines which may be fabricated of microstrip, strip lines, waveguides, or coaxial line. Frequency-scanning is obtained by introducing a progressive phase delay between the rf input and each subsequent conductive patch 10. In the embodiment shown in FIG. 11, the progressive phase delay is accomplished by increasing the length of the feed lines to each subsequent conductive patch by $\Delta L$, wherein, for example, the length of the feed line to the first conductive patch p1 is denoted as L, the length of the feed line to the next subsequent conductive patch p2 is denoted as $L+\Delta L$, etc. Control means 48 in response to a frequency input signal switches selected switching diodes 20 so that the frequency characteristics of each conductive patch 10 corresponds to the frequency input. As the frequency input changes the phase shift to each conductive patch changes, because the phase shift caused by the feed lines is frequency dependent, thereby changing the direction of the radiated beam. As can also be appreciated, polarization diversity can also be provided by making control means 48 responsive to a polarization input and switching selected shorting means to change polarization of each conductive patch 10, as explained above. FIG. 12A shows a microstrip antenna array comprising 8 conductive patches formed in a row on a dielectric substrate 12. FIGS. 12B–12D are graphical representations of three of the radiation patterns available from an antenna such as the one shown in FIG. 12A. These radiation patterns were measured and as it can be appreciated other radiation patterns can be obtained by selecting appropriate shorting means locations.

While the invention has been described with reference to the accompanying drawings, it is to be clearly understood that the invention is not to be limited to the particular details shown therein as obvious modifications may be made by those skilled in the art. The embodiments of the invention should only be construed within the scope of the following claims.

What we claim is:

1. A frequency agile microstrip antenna comprising:

a dielectric substrate;

a square conductive patch forming an energy radiator with an active radiating region defined by the sides of the square;

a conductive layer forming a ground plane on an opposed surface of said substrate;

input means for providing selectable frequency radio-frequency energy inputs to said conductive patch; and means for instantaneously changing the frequency characteristics of said active radiating region including means on the perimeter of and within the perimeter of said square patch selectively energizible to provide short circuits between said patch and said conductive layer.

2. The antenna as set forth in claim 1 wherein said selectively energizible means include switching diodes.

3. The antenna as set forth in claim 1 wherein said selectively energizible means are arranged in simultaneously energizible pairs.

4. The antenna as set forth in claim 1 wherein said selectively energizible means have members only along bisectors of opposite sides of the square conductive patch.

5. The antenna as set forth in claim 3 wherein said selectively energizible means include switching diodes.

6. The antenna as set forth in either claim 3 or 5 wherein said selectively energizible means have members only along bisectors of opposite sides of the square conductive patch.

7. The antenna as set forth in claim 2 wherein said selectively energizible means are arranged in simultaneously energizible pairs.

8. The antenna as set forth in either claim 2 or 7 wherein said selectively energizible means have members only along bisectors of opposite sides of the square conductive patch.

9. The antenna as set forth in claim 4 wherein said selectively energizible means are arranged in simultaneously energizible pairs.

10. The antenna as set forth in either claim 4 or 9 wherein said selectively energizible means include switching diodes.

* * * * *